US006445125B1

(12) United States Patent
Na et al.

(10) Patent No.: US 6,445,125 B1
(45) Date of Patent: Sep. 3, 2002

(54) FLAT PANEL DISPLAY HAVING FIELD EMISSION CATHODE AND MANUFACTURING METHOD THEREOF

(75) Inventors: Yang-woon Na; Sung-ho Jo; Soo-young Moon, all of Kyungki-do (KR)

(73) Assignee: Samsung Display Devices Co., Ltd., Suwon-si (KR)

( * ) Notice: Subject to any disclaimer, the term of this patent is extended or adjusted under 35 U.S.C. 154(b) by 0 days.

(21) Appl. No.: 09/282,353

(22) Filed: Mar. 30, 1999

(30) Foreign Application Priority Data

Apr. 2, 1998 (KR) ..... 98-11608

(51) Int. Cl.[7] ..... H01J 1/304; H01J 1/46; H01J 1/62

(52) U.S. Cl. ..... 313/497; 313/496; 313/495; 315/169.1

(58) Field of Search ..... 313/495, 496, 313/497, 309, 310, 336, 351, 422; 315/169.1, 169.3

(56) References Cited

U.S. PATENT DOCUMENTS 5,786,656 A * 7/1998 Hasegawa et al. ..... 313/308
6,163,107 A * 12/2000 Itoh et al. ..... 313/495
6,204,597 B1 * 3/2001 Xie et al. ..... 313/310
6,255,772 B1 * 7/2001 Cathey et al. ..... 313/495

FOREIGN PATENT DOCUMENTS

JP 11329308 A * 11/1999 ..... H01J/31/12

* cited by examiner

*Primary Examiner*—Nimeshkumar D. Patel
*Assistant Examiner*—Karabi Guharay
(74) *Attorney, Agent, or Firm*—Christie, Parker & Hale, LLP

(57) ABSTRACT

Disclosed is a flat panel display and a method for manufacturing the same. The flat display has a first substrate and a second substrate sealed in a vacuum at a predetermined interval to form a cell gap and including a plurality of spacers interposed therebetween, the second substrate including a plurality of anode electrodes formed in a predetermined pattern on one side thereof and a phosphor layer formed on the pattern of the anode electrodes. The flat panel display further includes a plurality of cathode electrodes formed in a predetermined pattern on the first substrate; an insulating layer disposed on the cathode electrodes and having a plurality of apertures formed therein; a plurality of field emission cathodes provided in the apertures of the insulating layer contacting the cathode electrodes; a gate electrode pattern realized through a plurality of gate electrodes, the gate electrode pattern being disposed on the insulating layer and having formed openings corresponding, in size and location, to the apertures of the insulating layer; and a plurality of focusing electrodes provided between the gate electrode pattern and the cathode electrodes, and which control the flow of electrons emitted from the same.

17 Claims, 7 Drawing Sheets

FLAT PANEL DISPLAY HAVING FIELD EMISSION CATHODE AND MANUFACTURING METHOD THEREOF

BACKGROUND OF THE INVENTION (a) Field of the Invention

The present invention relates to a flat panel display, and more particularly to a flat panel display having field emission cathodes and a manufacturing method thereof.

(b) Description of the Related Art

The various flat panel display configurations offer significant advantages over the traditional CRT display. These include a thin profile, reduced weight, low power requirements and improved picture quality. The different types of flat panel displays include the liquid crystal display (LCD), the vacuum fluorescent display (VFD), the plasma display panel (PDP), the field emission display (FED) and others.

FEDs utilize the well-established cathode-anode-phosphor technology built into full-sized CRTs, and use this in combination with the dot matrix cellular construction of LCDs. However, instead of using the single bulky tube of the CRT, FEDs use tiny 'mini tubes' for each pixel such that the display can be built in approximately the same size as an LCD screen. Also, rather than using a backlight which delivers light through a shutter-like structure as in the LCD, the FED is an emissive technology. As a result, FEDs provide good display quality at virtually any angle, a significant advantage over LCDs which, as a result of their backlight structure, lose clarity, contrast and color purity when viewed from different angles.

FIG. 7 shows a partial sectional view of a conventional FED. As shown in the drawing, the conventional FED comprises a back substrate 1 and a front substrate 3 separated by a vacuum and disposed at a predetermined distance. Cathode electrodes 5 are formed on the back substrate 1 and anode electrodes 7 are formed on the front substrate 3. The cathode electrodes 5 and the anode electrodes 7 are formed on the substrates 1 and 3 in a predetermined pattern, for example, a line pattern. The substrates 1 and 3 are sealed in this vacuum state such that a cell gap is formed therebetween, and a plurality of spacers 9 are disposed between the substrates 1 and 3 to maintain the predetermined cell gap.

An insulating layer 11, made of an oxide such as $SiO_2$, is formed on the cathode electrodes 5 of the back substrate 1, and a gate electrode pattern 13 is formed on the insulating layer 11. Further, as shown also in FIG. 8, a plurality of apertures 15 having a predetermined diameter D are formed with the absence of the gate electrode pattern 13 and the insulating layer 11, and field emission cathodes 17 are formed in the apertures 15 contacting the cathode electrodes 5 provided on the back substrate 1. The field emission cathodes 17 are substantially flat and made of a material having a low work function such as diamond or diamond-like carbon (DLC).

With regard to the front substrate 3, a phosphor layer 19 is deposited in a predetermined pattern on the anode electrodes 7 formed on the front substrate 3. Also, a black matrix 21 is formed at areas on the anode electrode 7 in which the phosphor layer 19 is not present.

In the conventional FED structured as in the above, when a voltage is applied between a portion of the gate electrode pattern 13 and the cathode electrodes 5 of the back substrate 1 corresponding to a desired pixel area, an -electric field is formed between corresponding field emission cathodes 17 and gate electrode pattern 13. As a result, electrons are emitted from the field emission cathodes 17 and accelerate across the cell gap formed between the two substrates 1 and 3. The electrons are then induced by the anode electrodes 7, to which a high voltage is applied, to the phosphor layer 19. Accordingly, the electrons strike the phosphor layer 19 such that the same is excited and the desired image is attained.

With such a FED, the diameter D of the apertures 15 directly affects the amount of electrons emitted from the field emission cathodes 17, thereby determining the performance of the FED. That is, as the difference increases between the diameter D of the apertures 15 and an effective thickness H of the insulating layer 11, derived by subtracting a thickness K of the field emission cathodes 17 from a total thickness H' of the insulating layer 11, increases the amount of electrons emitted from the field emission cathodes 17.

However, a problem results from enlarging the diameter D of the apertures 15 with respect to the effective thickness H of the insulating layer 11. Namely, such an increase, although improving the degree to which electrons are emitted from the field emission cathodes 17, act to directly add to the amount of electrons colliding with the gate electrode pattern 13 such that leakage easily occurs. This also causes the focusing state of the electrons induced to the phosphor layer 19 to be reduced, thereby resulting in the distortion of the images being displayed.

SUMMARY OF THE INVENTION

An embodiment of the present invention has been made in an effort to solve the above problems.

It is an object of an embodiment of the present invention to provide a flat panel display having field emission cathodes and a manufacturing method thereof in which the ability of electrons emitted from the cathodes to focus on a phosphor layer is not diminished regardless of how an insulating layer and a gate electrode pattern are designed.

To achieve the above object, an embodiment of the present invention provides a flat panel display having field emission cathodes and a manufacturing method thereof. The flat panel display has a first substrate and a second substrate sealed in a vacuum at a predetermined interval to form a cell gap and includes a plurality of spacers interposed therebetween. The second substrate includes a plurality of anode electrodes formed in a predetermined pattern on one side thereof and a phosphor layer formed on the pattern of the anode electrodes. The flat panel display further comprises a plurality of cathode electrodes formed in a predetermined pattern on the first substrate, an insulating layer disposed on the cathode electrodes and having a plurality of apertures formed therein, a plurality of field emission cathodes provided in the apertures of the insulating layer contacting the cathode electrodes, a gate electrode pattern formed with a plurality of gate electrodes, the gate electrode pattern being disposed on the insulating layer and having formed openings corresponding, in size and location, to the apertures of the insulating layer, and a plurality of focusing electrodes, provided between the gate electrode pattern and the cathode electrodes, which control the flow of electrons emitted from the field emission cathodes.

According to a feature of an embodiment of the present invention, the focusing electrodes are formed in a predetermined shape and disposed within the apertures of the insulating layer.

According to another feature of the present invention, the focusing electrodes are formed in a predetermined shape and disposed within the field emission cathodes.

According to yet another feature of an embodiment of the present invention, an insulating member is interposed between the cathode electrodes and each of the focusing electrodes.

According to still yet another feature of an embodiment of the present invention, surfaces of the focusing electrodes are substantially flat and made of a material having a low work function.

According to still yet another feature of an embodiment of the present invention, the apertures of the insulating layer and the focusing electrodes are substantially circular.

According to still yet another feature of an embodiment of the present invention, a diameter of the apertures is equal to or greater than a diameter of the focusing electrodes.

According to still yet another feature of an embodiment of the present invention, the diameter of the apertures is equal to or greater than an effective thickness of the insulating layer, the effective thickness being derived by subtracting a thickness of the field emission cathodes from a total thickness of the insulating layer.

According to still yet another feature of an embodiment of the present invention, the diameter of the apertures is between 1 and 10 $\mu$m, and the effective thickness of the insulating layer is between 0.5 $\mu$m and 6 $\mu$m.

The method of manufacturing a flat panel display of an embodiment of the present invention includes the steps of forming cathode electrodes in a predetermined pattern on one side of the first substrate; depositing a layer of insulating material used to form insulating members at a predetermined thickness on the pattern of the cathode electrodes, and depositing a material used to form focusing electrodes at a predetermined thickness on the insulating material; patterning the layers of material for the insulating members and the focusing electrodes in a predetermined shape to form a plurality of the insulating members and the focusing electrodes; depositing a material to form an insulating layer over the focusing electrodes and the insulating members at a predetermined thickness; depositing a material to form a gate electrode pattern at a predetermined thickness over the insulating layer; etching the gate electrode pattern and the insulating layer at areas corresponding to a location of the focusing electrodes and the insulating members such that apertures are formed in the insulating layer and openings are formed in the gate electrode pattern, thereby exposing the focusing electrodes and the insulating members, the apertures and the openings being substantially of the same shape and size; and depositing a material having a low work function over each pair of the focusing electrode and the insulating member within the apertures of the insulating layer to form field emission cathodes.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

A preferred embodiment of the present invention will now be described in detail with reference to the accompanying drawings.

Figure 1:
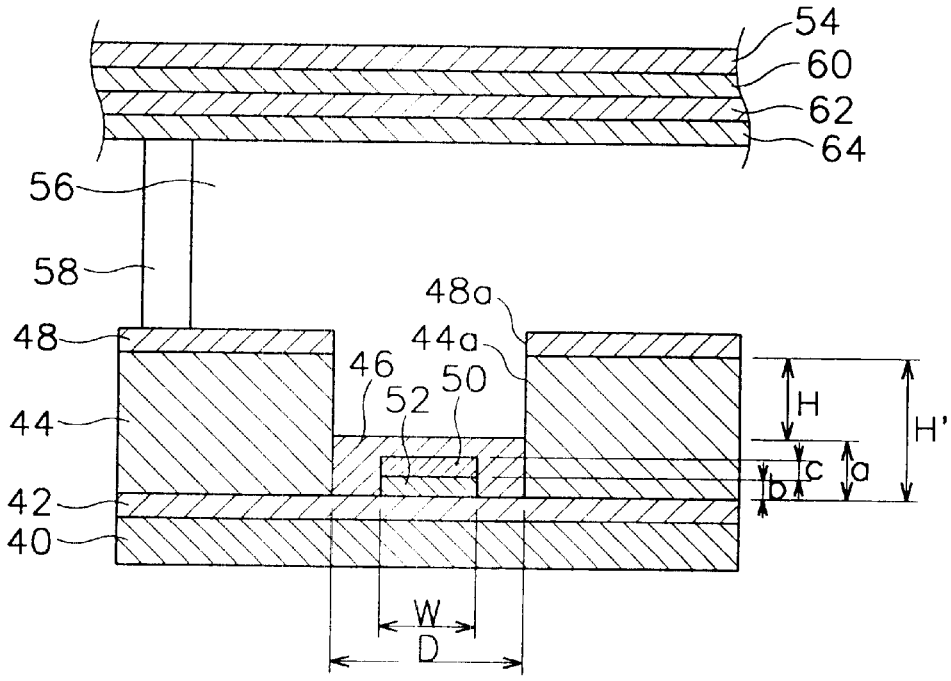
FIG. 1 is a partial sectional view of a flat panel display according to a preferred embodiment of the present invention.

FIG. 1 shows a partial sectional view of a flat panel display having field emission cathodes, i.e., a field emission display (FED), according to a preferred embodiment of the present invention. In the FED of an embodiment of the present invention, as with the conventional FED, electrons are emitted from field emitting cathodes arranged on a back substrate and are induced to a phosphor layer provided on a front substrate to illuminate the phosphor layer, thereby realizing a predetermined image. In a conventional FED, electrons tend to collide with gate electrodes resulting in an image that is not fully focused. An embodiment of the present invention provides a FED structure that overcomes this drawback of the prior art as described below.

Figure 2:
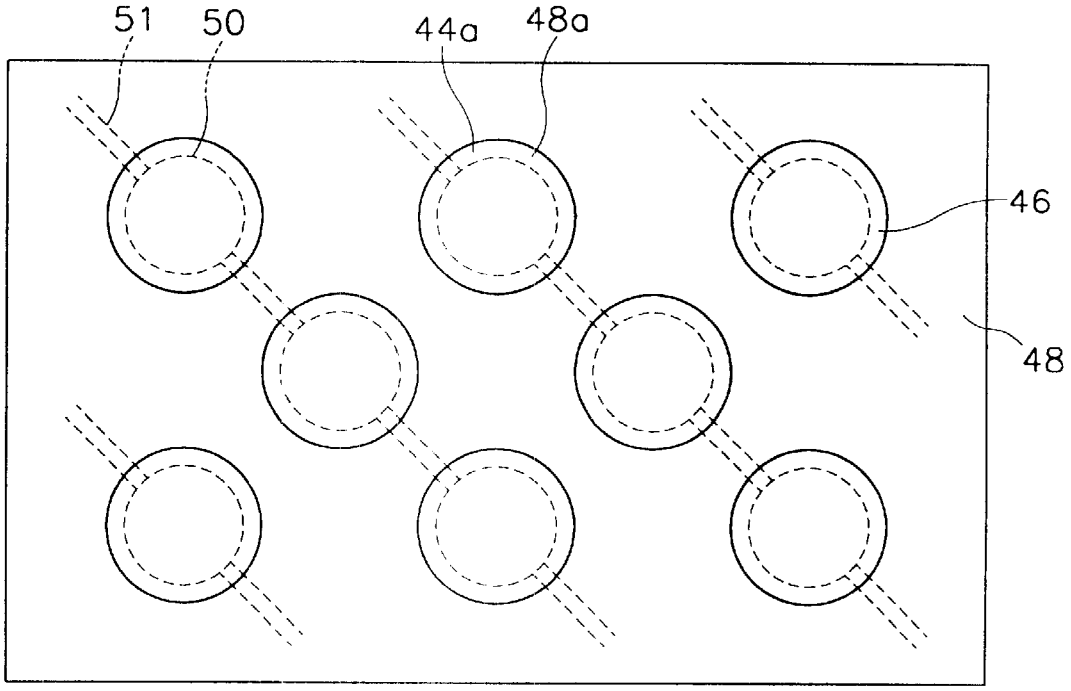
FIG. 2 is a partial plan view of a first substrate shown in FIG. 1.

As shown in FIG. 1, the FED according to a preferred embodiment of the present invention comprises a focusing electrode 50 provided in each of the field emission cathodes 46. The focusing electrodes 50 reduce leakage of electrons emitted from the field emission cathodes 46, and, at the same time, improve a focusing state of the electrons. Formed between a plurality of cathode electrodes 42 and each of the focusing electrodes 50 is an insulating member 52. As shown in FIG. 2, the focusing electrodes 50, represented by the dotted lines within the solid lines indicating an upper circumference of openings 48*a* forming a gate electrode pattern 48, are interconnected by wires 51 which supply voltage required to drive the focusing electrodes 50. That is, the wires 51 interconnect the focusing electrodes 50 of the field emission cathodes 46 adjacent in a diagonal direction with respect to an overall quadrilateral shape of the gate electrode pattern 48 of a first substrate 40.

Although the focusing electrodes 50, the field emission cathodes 46, a apertures 44*a* of a insulating layer 44 and the openings 48*a* of the gate electrode pattern 48 are described and/or appear in FIG. 2 as being cylindrical in shape, these elements are not limited to this shape and can be square or rectangular-shaped. However, whichever shape is used, it is preferable that all the above elements are of the same shape. In the case where a cylindrical shape is used, it is possible for a diameter D of the apertures 44*a* to be either larger than or identical to a diameter W of the focusing electrodes 50. In the present invention, the diameter D of the apertures 44*a* is greater than the diameter W of the focusing electrodes 50. If the diameter W of the focusing electrodes 50 is identical to the diameter D of the apertures 44*a*, the field emission cathodes 46 are formed over the focusing electrodes 50, rather than the focusing electrodes 50 being formed within the field emission cathodes 46 as described above. In either case, the insulating members 52 are the same size as the focusing electrodes 50.

The focusing electrodes 50 receive a predetermined voltage to form an electric field of a predetermined strength. The electric field generated by the focusing electrodes 50 affects the flow of electrons emitted from the field emission cathodes 46. That is, by the formation of an electric field between the cathode electrodes 42 and the gate electrode pattern 48 by the focusing electrodes 50, the focusing state of electron beams formed by the electrons emitted from the field emission cathodes 46 can be controlled. Accordingly, even with increases made in the diameter D of the apertures 44*a* in relation to an effective thickness H of the insulating layer 44, derived by subtracting the thickness (a) of the field emission cathodes 46 from the total thickness H' of the insulating layer 44, colliding of the electrons on the gate electrode pattern 48 does not occur.

Figure 4:
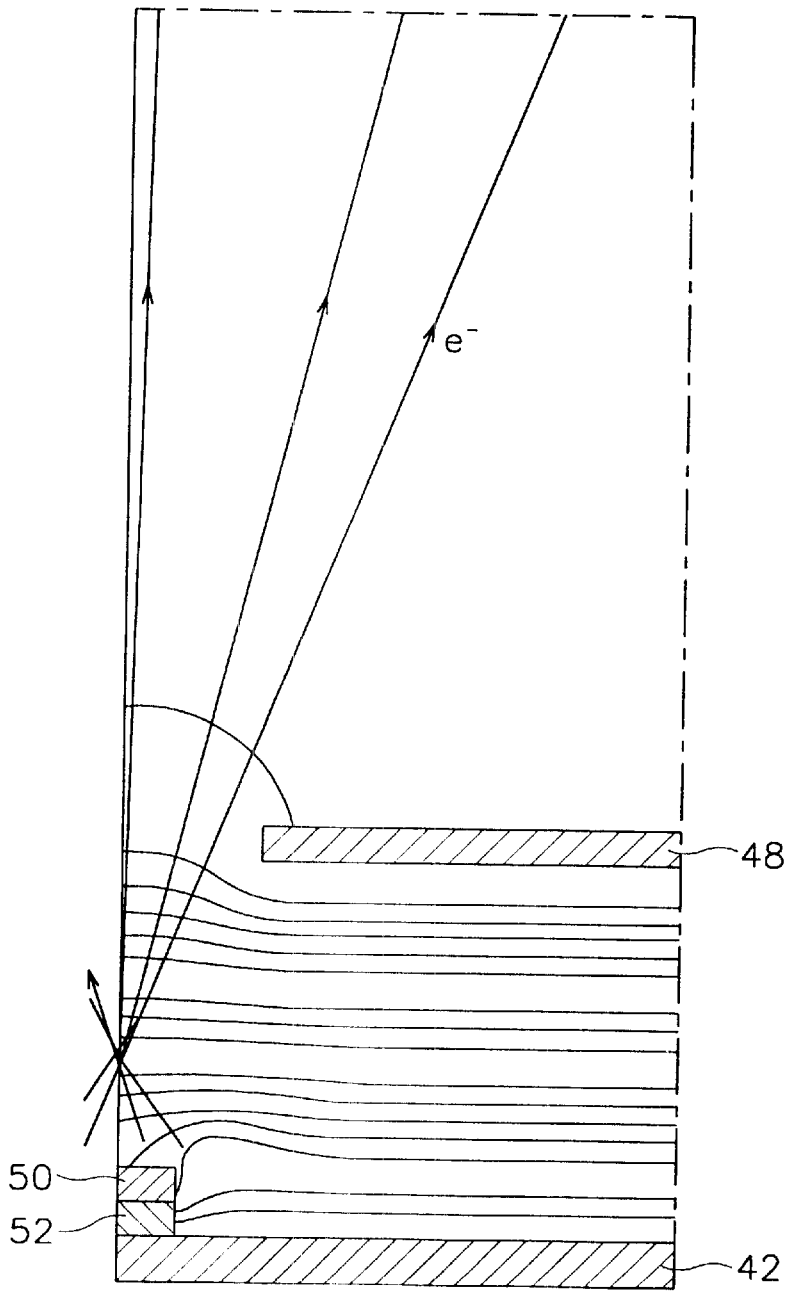
FIGS. 4, 5 and 6 are detailed partial sectional views of the flat panel display shown in FIG. 1 used to describe an operation of the same.

In a first test, after grounding the cathode electrodes 42, and applying 40V to the gate electrode pattern 48 and 10V to the focusing electrodes 50, the electron beams, as shown in FIG. 4, are induced to the anode electrodes 60 of the second substrate 54 in a state where the electrons ($e^-$) emitted from the field emission cathodes 46 cross as a result of an edge effect of the electric field generated by the focusing electrodes 50.

Figure 5:
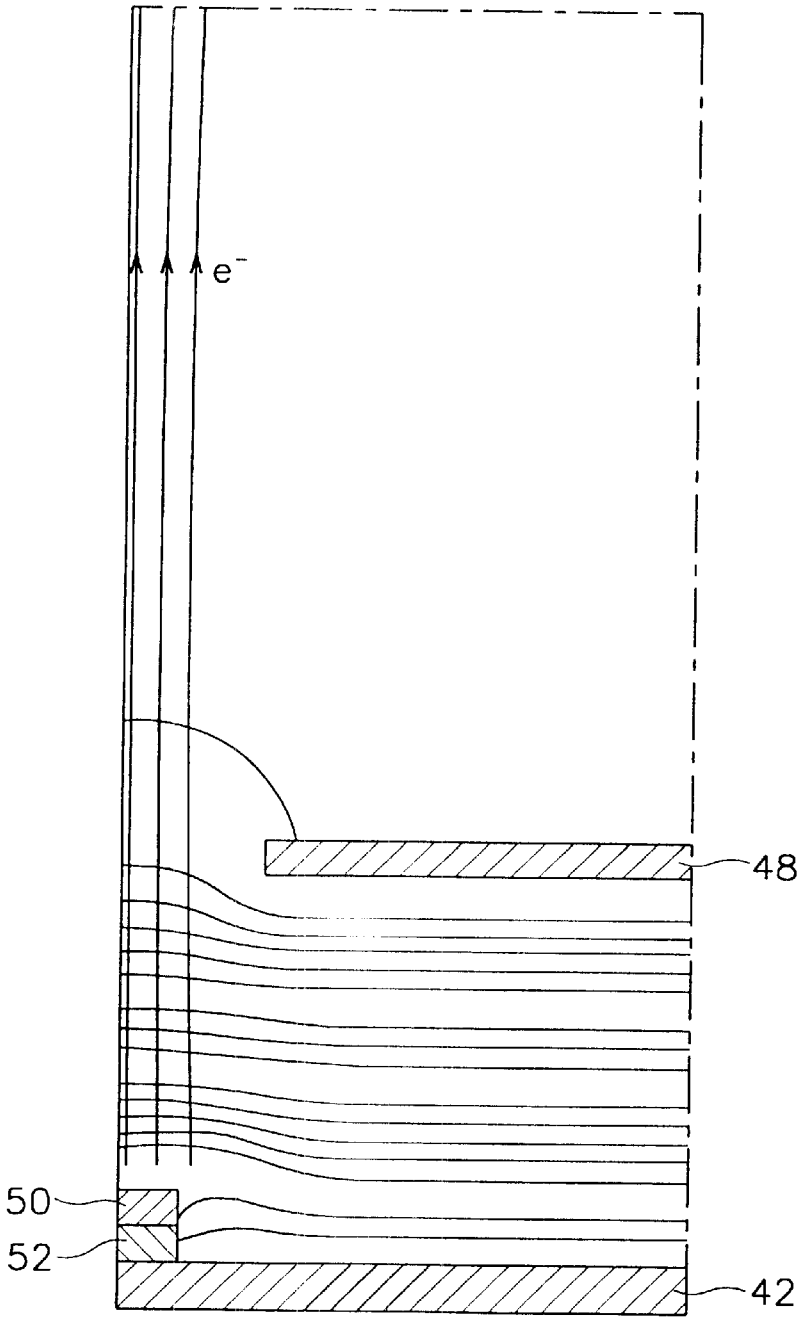

In a second test, after grounding the cathode electrodes 42, and applying 40V to the gate electrode pattern 48 and 5V to the focusing electrodes 50, the electron beams, as shown in FIG. 5, are induced to the anode electrodes 60 of the second substrate 54 in a state where the pathway of the electrons ($e^-$) emitted from the field emission cathodes 46 are parallel. In this case, a desirable effect is obtained by the levels of voltage applied.

Figure 6:
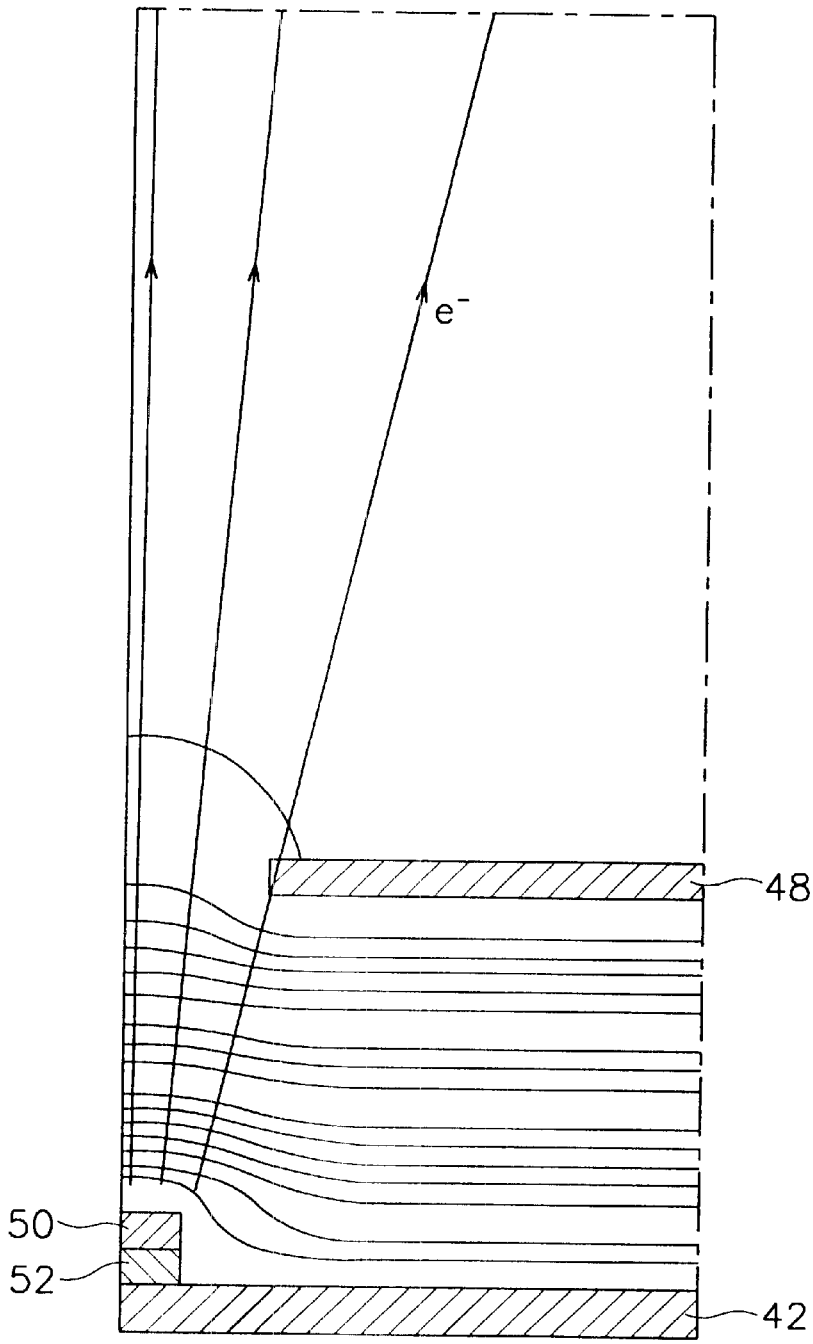
Figure 7:
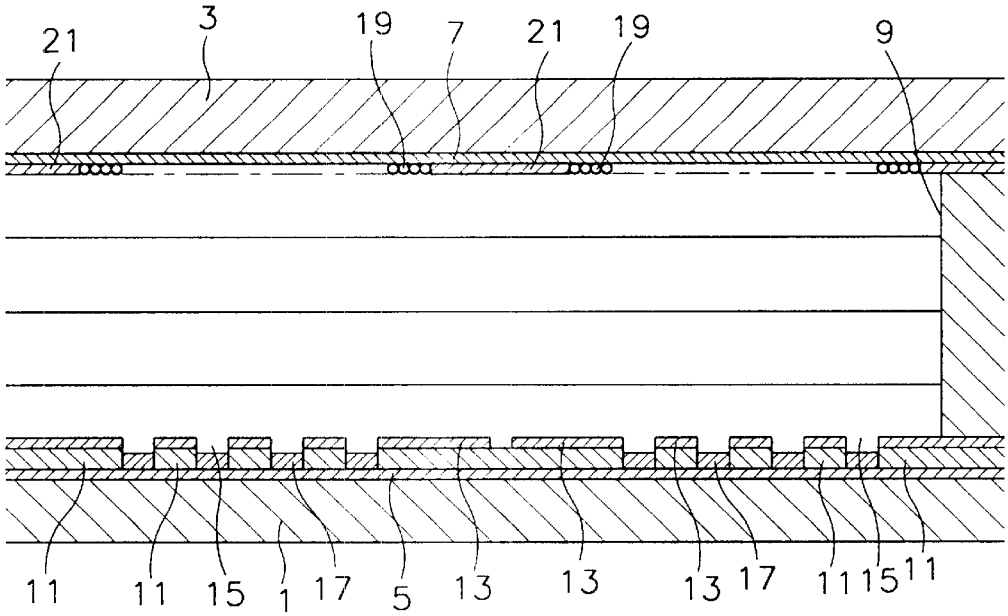
FIG.7 PRIOR ART
FIG. 7 is a partial sectional view of a conventional flat panel display; and FIG.
Figure 8:
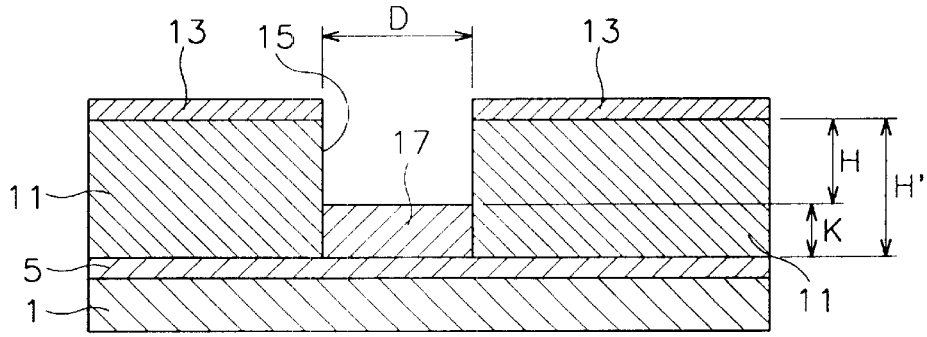
FIG.8 PRIOR ART
FIG. 8 is a detailed partial sectional view of the conventional flat panel display shown in FIG. 7.

In a third test, after grounding the cathode electrodes 42, and applying 40V to the gate electrode pattern 48 and 0V to the focusing electrodes 50, the electron beams, as shown in FIG. 6, are induced to the anode electrodes 60 of the second substrate 54 in a state where some of the electrons ($e^-$) emitted from the field emission cathodes 46 strike the gate electrode pattern 48, indicative of the occurrence of leakage.

As can be known from the above, by applying differing levels of voltage to the focusing electrodes 50, the pathway of the electron beams formed by the electrons discharged from the field emission cathodes 46 can be controlled. Accordingly, with the use of a suitable level of voltage for the focusing electrodes 50, the electron beams can be emitted in a state where they are parallel as shown in FIG. 5, thereby preventing leakage of the electrons to the gate electrode pattern 48. In an embodiment of the present invention, such compensation of the voltage applied to the gate electrode pattern 48 by the electric field formed by the focusing electrodes 50 can be realized when the diameter D of the apertures 44*a* is formed between 1 and 10 $\mu$m and the effective thickness H of the insulating layer 44 is maintained between 0.5 and 6 $\mu$m.

Figure 3:
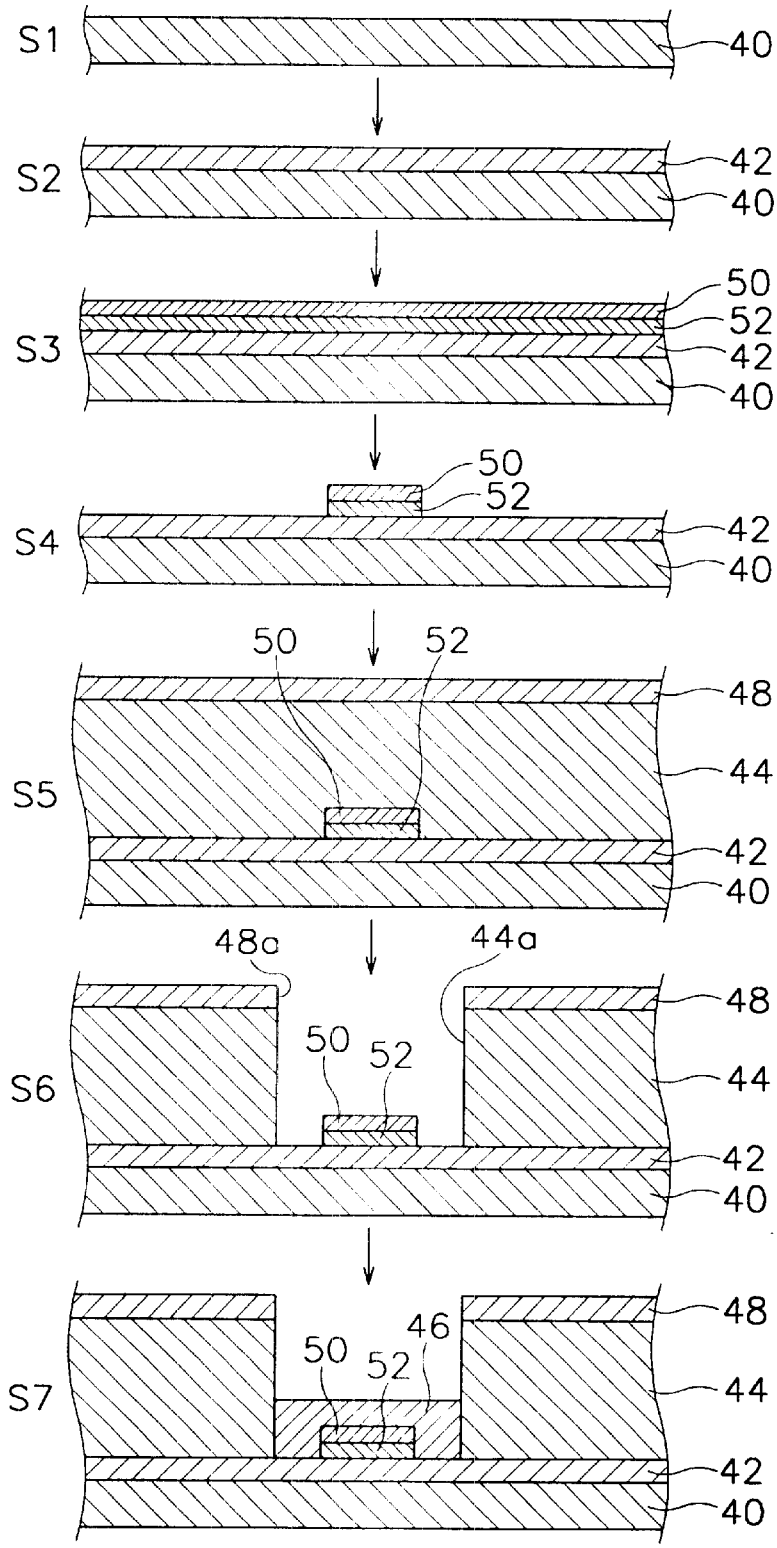
FIG. 3 is a partial sectional view of the first substrate shown in FIG. 1 as it undergoes sequential manufacturing steps.

Manufacture of the above cathode assembly formed on the first substrate 40 will now be described in detail with reference to FIG. 3 which shows a partial sectional view of the first substrate 40 illustrated in FIG. 1 as it undergoes sequential manufacturing steps.

First, in step S1, the first substrate 40 is manufactured using conventional methods. Next, the cathode electrodes 42 are formed in a predetermined pattern on one side of the first substrate 40 in step S2. Subsequently, in step S3, a layer of insulating material used for the insulating members 52 is deposited at a predetermined thickness on the pattern of the cathode electrodes 42, after which a material used to form the focusing electrodes 50 is deposited at a predetermined thickness on the insulating material. Following this step, the layers of material for the insulating members 52 and the focusing electrodes 50 are patterned in a predetermined shape, for example, a circular shape, to form a plurality of these two elements 52 and 50 in step S4.

Next, in step S5, a material to form the insulating layer 44 is deposited over the focusing electrodes 50 and the insulating members 52 at a predetermined thickness, and a material to form the gate electrode pattern 48 is formed at a predetermined thickness over the insulating layer 44. Subsequently, in step S6, the gate electrode pattern 48 and the insulating layer 44 are etched at areas corresponding to the location of the focusing electrodes 50 and the insulating members 52 such that the apertures 44*a* and the openings 48*a* are formed, thereby exposing the focusing electrodes 50 and the insulating members 52. Finally, in step S7, material having a low work function is deposited over each pair of the focusing electrode 50 and the insulating member 52 within the apertures 44*a* of the insulating layer 44 to form the field emission cathodes 46. Here, the field emission cathodes 46 are formed such that the thickness a of the field emission cathodes is less than the total thickness H of the insulating layer 44 (see FIG. 1).

With regard to the second substrate 54, a layer of a plurality of anode electrodes 60, corresponding to the cathode electrodes 42 of the first substrate 40, are formed on the second substrate 54. Further, a phosphor layer 62 having a predetermined pattern is formed on the layer of the anode electrodes 60, the phosphor layer 62 being made of a phosphor material. Also, in the case where the FED is a high-voltage-type FED, it is possible to deposit an aluminum layer 64 on the phosphor layer 62.

In the FED of an embodiment of the present invention structured as in the above, if a predetermined voltage is applied to the gate electrode pattern 48 to begin the operation of the FED, electrons are emitted from the field emission cathodes 46 and induced in a direction toward the anode electrodes 60 of the second substrate 54. Accordingly, the electrons strike the phosphor layer 62 such that the same is irradiated, thereby realizing a desired image.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A flat panel display having a first substrate and a second substrate spaced apart at a predetermined interval to form a vacuum sealed cell gap and including a plurality of spacers interposed therebetween, the second substrate including a plurality of anode electrodes formed in a predetermined pattern on one side thereof and a phosphor layer formed on the pattern of the anode electrodes, the flat panel display comprising:

a plurality of cathode electrodes formed in a predetermined pattern on the first substrate;

an insulating layer disposed on the cathode electrodes and having a plurality of apertures formed therein;

a plurality of field emission cathodes provided in the apertures of the insulating layer contacting the cathode electrodes;

a gate electrode pattern comprising a plurality of gate electrodes, the gate electrode pattern being disposed on the insulating layer and having openings corresponding, in size and location, to the apertures of the insulating layer; and a plurality of focusing electrodes provided between the gate electrode pattern and the cathode electrodes, and which control the flow of electrons emitted by the field emission cathodes;

wherein the focusing electrodes are formed in a predetermined shape and are disposed within the field emission cathodes.

2. The flat panel display of claim 1 wherein an insulating member is interposed between the cathode electrodes and each of the focusing electrodes.

3. The flat panel display of claim 1 wherein surfaces of the focusing electrodes are substantially flat and comprise a material having a low work function.

4. The flat panel display of claim 1 wherein the apertures of the insulating layer and the focusing electrodes are substantially circular.

5. The flat panel display of claim 4 wherein a diameter of the apertures is equal to or greater than a diameter of the focusing electrodes.

6. The flat panel display of claim 4 wherein a diameter of the apertures is equal to or greater than an effective thickness of the insulating layer, the effective thickness being derived by subtracting a thickness of the field emission cathodes from a total thickness of the insulating layer.

7. The flat panel display of claim 6 wherein the diameter of the apertures is between 1 and 10 $\mu$m.

8. The flat panel display of claim 6 wherein the effective thickness of the insulating layer is between 0.5 and 6 $\mu$m.

9. A flat panel display comprising:

first and second substrates;

a plurality of spacers interposed between the first and second substrates to form a cell gap therebetween, the cell gap being vacuum sealed;

an anode electrode disposed on the second substrate;

a phosphor layer disposed on the anode electrode;

a cathode electrode disposed on the first substrate;

an insulating layer disposed on the cathode electrode, the insulating layer having an aperture;

a field emission cathode positioned in the aperture of the insulating layer, the field emission cathode contacting the cathode electrode;

a gate electrode disposed on the insulating layer and having an opening corresponding to the aperture of the insulating layer; and a focusing electrode for controlling the flow of electrons emitted by the field emission cathode;

wherein the focusing electrode has a predetermined shape and is disposed within the field emission cathode.

10. The flat panel display of claim 9 wherein an insulating member is interposed between the cathode electrode and the focusing electrode.

11. The flat panel display of claim 9 wherein the field emission cathode comprises a substantially flat surface and a material having a low work function.

12. The flat panel display of claim 9 wherein the aperture of the insulating layer and the focusing electrode are substantially circular.

13. The flat panel display of claim 12 wherein a diameter of the aperture is greater than or equal to a diameter of the focusing electrode.

14. The flat panel display of claim 12 wherein a diameter of the aperture is greater than or equal to an effective thickness of the insulating layer, the effective thickness being derived by subtracting the thickness of the field emission cathode from the total thickness of the insulating layer.

15. The flat panel display of claim 14 wherein the diameter of the aperture is between 1 and 10 $\mu$m.

16. The flat panel display of claim 14 wherein the effective thickness of the insulating layer is between 0.5 and 6 $\mu$m.

17. A flat panel display, comprising:

a substrate;

a cathode electrode disposed on the substrate;

an insulating layer disposed on the cathode electrode, said insulating layer having an aperture;

a field emission cathode disposed in the aperture of the insulating layer and contacting the cathode electrode; and a focusing electrode disposed within the field emission cathode.

* * * * *